US005158486A

United States Patent [19]

Tamame

[11] Patent Number: 5,158,486

[45] Date of Patent: Oct. 27, 1992

[54] DEBRIS AND WEATHER PROTECTOR FOR AIR CONDITIONAL COMPRESSOR CABINETS

[76] Inventor: Antonio N. Tamame, 1910 Georgia, Deer Park, Tex. 77536

[21] Appl. No.: 667,321

[22] Filed: Mar. 11, 1991

[51] Int. Cl.[5] ..... F25B 39/04

[52] U.S. Cl. ..... 62/506; 49/463; 160/368.1; 160/DIG. 16; 165/134.1; 454/347

[58] Field of Search ..... 62/506, 507; 98/116; 49/463; 160/DIG. 16, 368.1; 165/134.1

[56] References Cited

U.S. PATENT DOCUMENTS 4,371,026 2/1983 Miller et al. ..... 160/DIG. 16
4,815,530 3/1989 Scott ..... 62/507

*Primary Examiner*—Ronald C. Capossela
*Attorney, Agent, or Firm*—Kenneth A. Roddy

[57] ABSTRACT

A lightweight weather-resistant cover for attachment to air conditioner compressor cabinets of the type containing a fan and having an opening in a wall of the cabinet for exhausting air. The cover has an attachment portion for attachment to the cabinet wall adjacent the exhaust opening and a lid portion of sufficient size to cover the exhaust opening and is hinged to the attachment portion. The lid portion is normally maintained in a closed position covering the exhaust opening when the fan is not operating and is pivoted to an open position extending angularly above the exhaust opening by the exhaust air when the fan is operating. When the fan ceases operation, the lid portion drops back down onto the cabinet wall to cover the opening and prevent the elements and other foreign matter from entering. The attachment portion may be secured to the wall of the cabinet by a strip of magnetic material or tape. The underside of the lid portion may be provided with a releasable fastener element to releasably engage the wall of the cabinet and prevent the lid portion from flapping against the cabinet wall under windy conditions when the fan is not operating.

11 Claims, 1 Drawing Sheet

DEBRIS AND WEATHER PROTECTOR FOR AIR CONDITIONAL COMPRESSOR CABINETS

BACKGROUND OF THE INVENTION

1. Field of the Invention

This invention relates generally to covers for air conditioner compressor cabinets, and more particularly to a cover for air conditioner compressor cabinets which will allow air to be exhausted from the compressor cabinet during periods of operation and which will protect the components inside the cabinet from the elements and other foreign matter when the compressor is not running.

2. Brief Description of the Prior Art

Central air conditioning is common in most residences and commercial buildings. The central air conditioning system has a compressor unit which is usually outside the building. The compressor unit along with its associated coils, electrical components, and a fan, are housed in a box-like sheetmetal enclosure or cabinet mounted on a concrete slab. The fan draws air into the cabinet enclosure through fixed louvers or slots on one or more sides of the cabinet and across the coils. The heated air is exhausted through a large circular opening in the top wall of the cabinet.

When the air is exhausting, rain and debris are prevented from entering through the large opening in the top wall of the cabinet due to the upward force of the exhaust air. However, the compressor unit only operates intermittently, and during the off periods, the large opening in the top wall of the cabinet allows rain and debris to enter the cabinet. When the compressor unit is inoperative, dust, dirt, and other debris will collect inside the cabinet and during periods of adverse weather, rain, sleet, or snow will fall into the cabinet through the top opening. Needless to say, these conditions have a deleterious effect on all the expensive components within the cabinet enclosure.

Therefore, there it would be desirable to provide a cover for air conditioner compressor unit cabinets which will allow air to be exhausted from the compressor cabinet during periods of operation and which will protect the components inside the cabinet from the elements and other foreign matter when the compressor is not running.

There are several patents which disclose covers of various construction for use in protecting air conditioner compressor units against the elements and other foreign matter.

Wooden, U.S. Pat. No. 4,745,769 discloses a central air conditioner cover apparatus comprising a sheet of flexible material, such as canvas, which is provided with numerous strategically-placed fasteners and openings to allow the cover to fit a wide range of air conditioner cabinets.

Hughes, U.S. Pat. No. 4,730,423 discloses a screen attached to a frame having four legs to support the assembly a predetermined distance above the ground for shielding an air conditioner/heat pump from the direct rays of the sun.

Bowman et al, U.S. Pat. No. 3,242,686 discloses a unitary, pre-assembled compressor room which has louvers in the front wall and houses a plurality of compressor units. Each unit and its related louvers are operated in accordance with its own temperature requirements.

Hoyle, U.S. Pat. No. 3,481,153 discloses a front door assembly for room air conditioners which has an outer frame secured to the unit and an inner frame member swingably carried by the outer frame member. A plurality of door portions are connected to the inner and outer frame members, one of which is pivotally mounted on the outer frame member and slidably associated with the inner frame member. The other door portions are immovably secured to the inner frame member. When one door portion is swung downwardly, the other door portion is swung outwardly to provide air ingress and egress to the interior of the unit.

The present invention is distinguished over the prior art in general, and these patents in particular by a lightweight weather-resistant cover for attachment to air conditioner compressor cabinets of the type containing a fan and having an opening in a wall of the cabinet for exhausting air. The cover has an attachment portion for attachment to the cabinet wall adjacent the exhaust opening and a lid portion of sufficient size to cover the exhaust opening and is hinged to the attachment portion. The lid portion is normally maintained in a closed position covering the exhaust opening when the fan is not operating and is pivoted to an open position extending angularly above the exhaust opening by the exhaust air when the fan is operating. When the fan ceases operation, the lid portion drops back down onto the cabinet wall to cover the opening and prevent the elements and other foreign matter from entering. The attachment portion may be secured to the wall of the cabinet by a strip of magnetic material or tape. The underside of the lid portion may be provided with a releasable fastener element to releasably engage the wall of the cabinet and prevent the lid portion from flapping against the cabinet wall under windy conditions when the fan is not operating.

SUMMARY OF THE INVENTION

It is therefore an object of the present invention to provide a weather-resistant cover which may be easily and quickly attached to the existing cabinet of air conditioner compressor units of the type containing a fan and having an opening in a wall of the cabinet for exhausting air.

It is another object of this invention to provide a weather-resistant cover which when attached to the existing cabinet of air conditioner compressor units of the type containing a fan and having an opening in a wall of the cabinet for exhausting air which will allow air to be exhausted from the compressor cabinet during periods of operation and which will close the exhaust opening to protect the components inside the cabinet from the elements and other foreign matter when the compressor is not running.

Another object of this invention to provide an improved cabinet enclosure for air conditioner compressor and fan units which has a cover member which will allow air to be exhausted from the compressor cabinet during periods of operation and which will close the exhaust opening to protect the components inside the cabinet from the elements and other foreign matter when the compressor is not running.

Another object of this invention is to provide a weather-resistant cover for the cabinet of air conditioner compressor units of the type containing a fan and having an opening in a wall of the cabinet for exhausting air which will automatically cover the exhaust opening when the fan is not operating.

A further object of this invention is to provide a weather-resistant cover which when attached to the existing cabinet enclosure of air conditioner compressor and fan units of the type having an opening in a wall of the cabinet for exhausting air which will extend the life of the compressor and fan units and reduce the likelihood of damage caused from the elements and other foreign matter entering the enclosure when the compressor is not running.

A still further object of this invention is to provide a weather-resistant cover which is attached to the existing cabinet of air conditioner compressor units to cover the exhaust opening of the cabinet which is simple in design and construction, economical to manufacture, and rugged and durable in use.

Other objects of the invention will become apparent from time to time throughout the specification and claims as hereinafter related.

The above noted objects and other objects of the invention are accomplished by a lightweight weather-resistant cover for attachment to air conditioner compressor cabinets of the type containing a fan and having an opening in a wall of the cabinet for exhausting air. The cover has an attachment portion for attachment to the cabinet wall adjacent the exhaust opening and a lid portion of sufficient size to cover the exhaust opening and is hinged to the attachment portion. The lid portion is normally maintained in a closed position covering the exhaust opening when the fan is not operating and is pivoted to an open position extending angularly above the exhaust opening by the exhaust air when the fan is operating. When the fan ceases operation, the lid portion drops back down onto the cabinet wall to cover the opening and prevent the elements and other foreign matter from entering. The attachment portion may be secured to the wall of the cabinet by a strip of magnetic material or tape. The underside of the lid portion may be provided with a releasable fastener element to releasably engage the wall of the cabinet and prevent the lid portion from flapping against the cabinet wall under windy conditions when the fan is not operating.

DESCRIPTION OF THE PREFERRED EMBODIMENT

Figure 1:
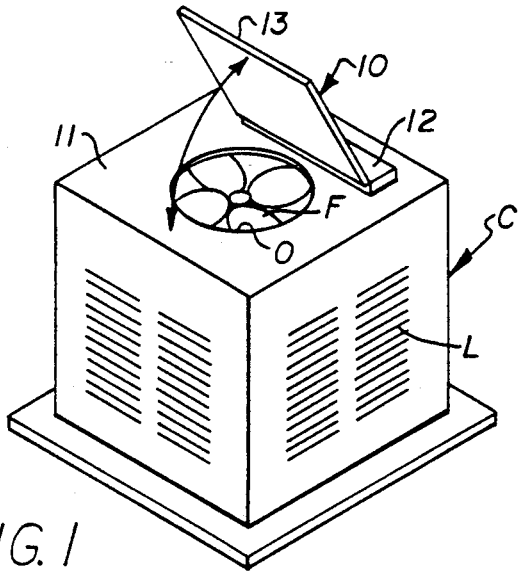
FIG. 1 is an isometric view of an air conditioner compressor cabinet having a debris and weather protection cover in accordance with the present invention installed thereon.
Figure 2:
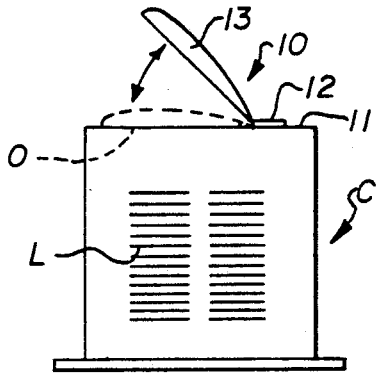
FIG. 2 is a side elevation of an air conditioner compressor cabinet having a debris and weather protection cover installed thereon.

Referring to the drawings by numerals of reference, there is shown in FIG. 1, an air conditioner compressor cabinet C having a preferred cover 10 in accordance with the present invention installed thereon. The compressor cabinet C is a box-like, or cylindrical enclosure formed of sheetmetal usually mounted on a concrete slab on the outside of a residence or commercial building. The compressor cabinet C contains the compressor unit along with its normal associated coils, electrical controls, and a fan F. The fan F draws air into the cabinet through fixed louvers or slots L on one or more sides of the cabinet and across the coils. The heated air is exhausted through a large circular opening O in the top wall 11 of the cabinet C.

Figure 3:
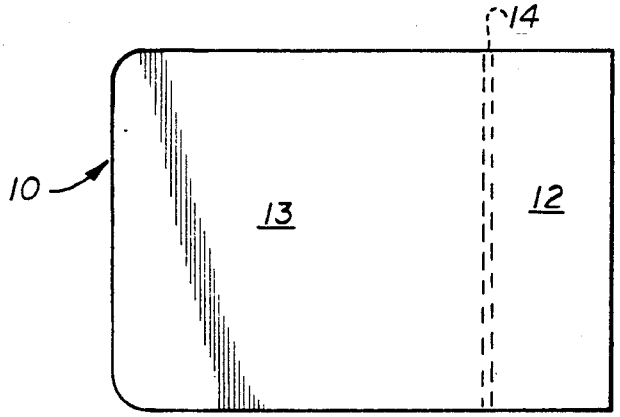
FIG. 3 is a top plan view of the debris and weather protection cover for air conditioner compressor cabinets.
Figure 4:
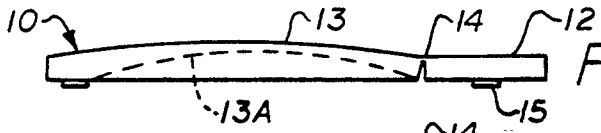
FIG. 4 is a side elevation of the debris and weather protection cover for air conditioner compressor cabinets.
Figure 5:
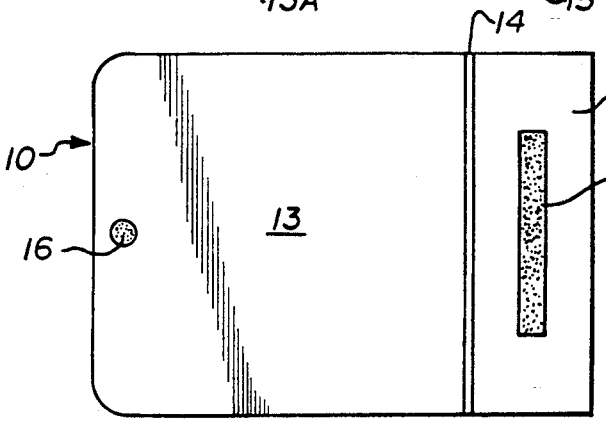
FIG. 5 is a bottom plan view of the debris and weather protection cover for air conditioner compressor cabinets.

As best seen in FIGS. 3, 4, and 5, the cover 10 is a generally square or rectangular member constructed of lightweight weather resistant material. The cover 10 has a generally rectangular attachment portion 12 and a relatively larger lid portion 13 which is hingedly connected to the lid portion along one longitudinal side by a hinge 14.

An attachment element 15 is secured to the underside of the attachment portion 12 for securing the attachment portion onto the top surface 11 of the compressor cabinet C adjacent the opening O such that the lid portion 13 will cover the opening O. The lid portion 13 is pivotally movable about the hinge 14 to move between a closed position covering the opening O and an open position raised angularly above the opening O.

The weight of the material used for the cover 10 is sufficient to allow the lid portion 13 to be raised off the top surface of the compressor cabinet C by the air exhausted through the opening O when the fan is in operation, and to allow the lid to drop by gravity back down onto the top surface 11 to cover the opening O when the fan is not running.

Optionally, a small strip or dot of magnetic tape 16 may be secured to the underside of the lid portion 13 near its outer edge to provide a releasable fastener element to prevent the lid portion from flapping against the cabinet top surface 11 under windy conditions when the fan is off. In this instance, the size or strength of the magnetic dot or strip would be sufficient to allow its release due to the force of exhaust air when the fan is blowing, but prevent its release when the lid portion is subjected to upward wind gusts of less force than the exhaust air.

The cover 10 may be made of molded rigid plastic material, and the hinge 14 may be formed as an integral "living hinge" between the lid portion and attachment portion during the molding operation. The attachment element 15 may be a strip of magnetic tape for releasably attaching the cover 10 to the compressor cabinet, or other conventional fasteners may be used whereby the cover can be permanently installed on the compressor cabinet. For example, holes may be provided in the attachment portion 12 and holes drilled in the top surface 11 of the compressor cabinet C and sheet metal screws installed therethrough. The top surface of the lid portion may be rounded to prevent water from collecting thereon. Optionally, the underside of the lid portion may be contoured 13A to facilitate lifting by the exhaust air.

A less expensive cover embodiment may be made of molded polystyrene (Styrofoam TM ) with a strip of tape serving as the hinge between the attachment portion and the lid portion. Double sided tape on the underside of the attachment member may also be used as the attachment element.

OPERATION

The cover member 10 is placed on the top surface of the compressor cabinet C with the lid portion 13 covering the opening O. The attachment element 15 on the underside of the attachment portion 12 is attached to the cabinet top surface 11.

When the compressor is running, the fan draws air into the cabinet through fixed louvers or slots L on one or more sides of the cabinet and across the coils. The heated air is exhausted through the circular opening O in the top wall of the cabinet C. When the air is exhausting, the force of the exhaust air will raise the lid portion 13 to its open position, however in this position rain and debris are prevented from entering through the opening due to the upward force of the exhaust air.

When the fan shuts off, the lid portion 13 will drop by gravity back down to its closed position covering the opening O to prevent rain and debris from entering through the opening.

Thus, as the fan goes through run and off periods, the lid portion 13 will pivotally move about the hinge 14 between its open and closed positions to cover the opening O when the fan is off and to assume its raised position angularly above the opening O due to the air exhausted through the opening O when the fan is in operation. When the compressor unit is inoperative, the opening O is covered such that dust, dirt, and other debris are prevented from entering through the opening. Even during periods of adverse weather, rain, sleet, or snow cannot fall into the cabinet through the opening O.

While this invention has been described fully and completely with special emphasis upon several preferred embodiments, it should be understood that within the scope of the appended claims the invention may be practiced otherwise than as specifically described herein.

I claim:

1. A cover for attachment to air conditioner compressor cabinets of the type containing a fan and having an opening in a wall of the cabinet for exhausting air, the cover comprising;

a cover member formed of lightweight weather resistant plastic material having a flat rectangular attachment portion for attachment to the cabinet wall adjacent the exhaust opening and a polygonal lid portion of sufficient size to cover the exhaust opening and hingedly connected along one side edge to one side edge of said attachment portion to move between a closed position covering the exhaust opening and an open position raised angularly above the exhaust opening, attachment means on the underside of said attachment portion for attaching said attachment portion to the cabinet wall, hinge means connecting said lid portion to said attachment portion, said lid portion being moved to its open position by the air exhausted through the exhaust opening when the fan is operating and allowed to drop by gravity down onto the cabinet wall to cover the opening when the fan is not operating, a releasable fastener element on the underside of said lid portion near its outer edge to releasably engage the wall of the cabinet and prevent said lid portion from flapping against the cabinet wall under windy conditions when the fan is not operating, and said fastener element being of sufficient strength to allow said lid portion to become disengaged from the cabinet wall due to the force of exhaust air when the fan is blowing, but prevent its disengagement when said lid portion is subjected to upward wind gusts of less force than the exhaust air.

2. A cover for attachment to air conditioner compressor cabinets according to claim 1 wherein said hinge means is an integral hinge.

3. A cover for attachment to air conditioner compressor cabinets according to claim 1 in which said attachment means is a magnetic element secured to the underside of said attachment portion for releasably securing said attachment portion onto the wall of the compressor cabinet.

4. A cover for attachment to air conditioner compressor cabinets according to claim 3 wherein said magnetic element is a strip of magnetic tape material.

5. A cover for attachment to air conditioner compressor cabinets according to claim 1 including a releasable fastener element on the underside of said lid portion near its outer edge to releasably engage the wall of the cabinet and prevent said lid portion from flapping against the cabinet wall under windy conditions when the fan is not operating, said fastener element being of sufficient strength to allow said lid portion to become disengaged from the cabinet wall due to the force of exhaust air when the fan is blowing, but prevent its disengagement when said lid portion is subjected to upward wind gusts of less force than the exhaust air.

6. A cover for attachment to air conditioner compressor cabinets according to claim 1 wherein said releasable fastener element is a small portion of magnetic material secured to the underside of said lid portion.

7. A cover for attachment to air conditioner compressor cabinets according to claim 1 wherein the underside of said lid portion is contoured to provide a concave bottom surface to facilitate lifting by the exhaust air and its top surface is rounded outwardly to prevent water from collecting thereon.

8. In combination with an air conditioner unit having a cabinet enclosure with a fan housed thereon for inducting air thereinto and having an exhaust opening in a wall of the cabinet for exhausting air therefrom, a cover member formed of lightweight weather resistant material having a flat rectangular attachment portion attached to the cabinet wall adjacent the exhaust opening and having a polygonal lid portion of sufficient size to cover the exhaust opening and hingedly connected along one side edge to one side edge of said attachment portion to move between a closed position covering the exhaust opening and an open position raised angular above the exhaust opening, said lid portion being moved to its open position by the air exhausted through the exhaust opening when the fan is operating and allowed to drop by gravity down onto the cabinet wall to cover the opening when the fan is not operating, a releasable fastener element on the underside of said lid portion near its outer edge to releasably engage the wall of the cabinet and prevent said lid portion from flapping against the cabinet wall under windy conditions when the fan is not operating, and said fastener element being of sufficient strength to allow said lid portion to become disengaged from the cabinet wall due to the force of exhaust air when the fan is blowing, but prevent its disengagement when said lid portion is subjected to upward wind gusts of less force than the exhaust air.

9. The combination according to claim 8 wherein said releasable fastener element is a small portion of magnetic material secured to the underside of said cover member.

10. The combination according to claim 8 wherein the underside of said lid portion is contoured to provide a concave bottom surface to facilitate lifting by the exhaust air and its top surface is rounded outwardly to prevent water from collecting thereon.

11. An improved pivotal cover for releasable attachment to air conditioner compressor cabinets of the type containing a fan and having an opening in a wall of the cabinet for exhausting air, the cover comprising;

a cover member formed of lightweight weather resistant plastic material having a flat rectangular attachment portion for attachment to the cabinet wall adjacent the exhaust opening and a polygonal lid portion of sufficient size to cover the exhaust opening and hingedly connected along one side edge to one side edge of said attachment portion to move between a closed position covering the exhaust opening and an open position raised angularly above the exhaust opening, the underside of said lid portion contoured to provide a concave bottom surface to facilitate lifting by the exhaust air and its top surface rounded outwardly to prevent water from collecting thereon, a magnetic element secured to the underside of said attachment portion for releasably securing said attachment portion onto the wall of the compressor cabinet, hinge means connecting said lid portion to said attachment portion, said lid portion being moved to its open position by the air exhausted through the exhaust opening when the fan is operating and allowed to drop by gravity down onto the cabinet wall to cover the opening when the fan is not operating, a releasable fastener element on the underside of said lid portion near its outer edge to releasably engage the wall of the cabinet and prevent said lid portion from flapping against the cabinet wall under windy conditions when the fan is not operating, and said releasable magnetic element being of sufficient strength to allow said lid portion to become disengaged from the cabinet wall due to the force of exhaust air when the fan is blowing, but prevent its disengagement when said lid portion is subjected to upward wind gusts of less force than the exhaust air.

* * * * *